US008316751B2

(12) United States Patent
Dillon

(10) Patent No.: US 8,316,751 B2
(45) Date of Patent: Nov. 27, 2012

(54) BARREL CLAMP SAFETY RETAINER

(76) Inventor: Michael John Dillon, Scottsdale, AZ (US)

( * ) Notice: Subject to any disclaimer, the term of this patent is extended or adjusted under 35 U.S.C. 154(b) by 0 days.

(21) Appl. No.: 12/932,828

(22) Filed: Mar. 8, 2011

(65) Prior Publication Data

US 2012/0227577 A1 Sep. 13, 2012

(51) Int. Cl.
*F41F 1/00* (2006.01)

(52) U.S. Cl. ..... 89/12; 89/14.3; 24/284

(58) Field of Classification Search ..... 89/12, 14.3; 24/284, 285
See application file for complete search history.

(56) References Cited

U.S. PATENT DOCUMENTS 3,706,259 A * 12/1972 Ashley et al. ..... 89/12
4,114,510 A * 9/1978 Prince et al. ..... 89/12
4,121,496 A * 10/1978 Clayson ..... 89/37.16
6,581,492 B1 * 6/2003 Chen ..... 74/551.3
7,341,287 B2 * 3/2008 Gibb et al. ..... 285/367
7,931,310 B2 * 4/2011 Lake ..... 285/365

* cited by examiner

*Primary Examiner* — Daniel Troy
(74) *Attorney, Agent, or Firm* — Bennet K. Langlotz; Langlotz Patent & Trademark Works, Inc.

(57) ABSTRACT

A minigun having a plurality of barrels. At least one barrel has a lug. A barrel clamp is attached to the barrels. The barrel clamp has a rear portion with apertures to receive the barrels. The barrel clamp has a front portion with apertures to receive the free end of the barrels. A clamp collar captures both the rear portion of the barrel clamp and at least one lug. The clamp collar may have two parts that are hingedly attached at one end and releasably pinned at the other end. Each of the two parts may have two flanges. The two flanges may be spaced apart by a distance defined by the barrel clamp's length. Each of the flanges may include a plurality of scallops. The clamp collar and the barrel clamp may each include a plurality of apertures that are aligned when the clamp collar is closed.

10 Claims, 9 Drawing Sheets

BARREL CLAMP SAFETY RETAINER

FIELD OF THE INVENTION

The present invention relates generally to automatic weapons of the Gatling machine gun type and, more specifically, to the Gatling gun known as the minigun.

BACKGROUND OF THE INVENTION

The minigun, hereinafter referred to as either a minigun or machine gun, is a six-barreled, electrically-driven machine gun capable of fixed firing rates of either 3000 or 4000 rounds per minute. The high rates of fire are achieved by employing barrels that rotate at 500 RPM or 666.67 RPM. The rapid rotation and vibration can cause fasteners that secure a barrel clamp to the barrels to come off if the fasteners are not attached properly. If the fasteners come off while the machine gun is operating, the barrel clamp will be allowed to slip forward and into the line of fire, creating a dangerous and destructive situation.

Historically, the barrel clamp bolt has been known to fall out, allowing the barrel clamp to fall off during operation. Over the years several different configurations have been used, including a self-locking nut, which was eventually replaced by a castellated nut and cotter pin arrangement. The main problem with the self-locking nut was that the locking portion of the nut would wear out due to repeated installation and removal, resulting in the nut backing off the bolt during operation. When attached properly, the improved barrel clamp bolt, castellated nut, and cotter pin arrangement have been shown to adequately fasten the barrel clamp to the barrels; however, the fasteners have been shown to be vulnerable to improper installation. Essentially three failure modes are known. The first occurs when the self-locking nut wears out. When the minigun is fired, the nut eventually backs off, which causes the barrel clamp bolt to fall out and the barrel clamp to slip off. The second occurs when the minigun operator forgets to install the cotter pin in the castellated nut. When the minigun is fired, the nut eventually backs off, which causes the barrel clamp bolt to fall out and the barrel clamp to slip of The third occurs when the barrel clamp bolt is overtightened. When the minigun is fired, the bolt heats up and breaks because it cannot expand. The barrel clamp bolt then falls out, and the barrel clamp slips off.

Therefore, there is a need for a barrel clamp safety retainer that secures a barrel clamp to the barrels even if the barrel clamp's fasteners come off.

SUMMARY OF THE INVENTION

The present invention provides an improved barrel clamp safety retainer, and overcomes the above-mentioned disadvantages and drawbacks of the prior art. As such, the general purpose of the present invention, which will be described subsequently in greater detail, is to provide an improved barrel clamp safety retainer that has all the advantages of the prior art mentioned above.

To attain this, the preferred embodiment of the present invention essentially comprises a minigun having a plurality of barrels. At least one barrel has a lug. A barrel clamp is attached to the barrels. The barrel clamp has a rear portion with apertures to receive the barrels. The barrel clamp has a front portion with apertures to receive the free end of the barrels. A clamp collar captures both the rear portion of the barrel clamp and at least one lug. The clamp collar may have two parts that are hingedly attached at one end and releasably pinned at the other end. Each of the two parts may have two flanges. The two flanges may be spaced apart by a distance defined by the barrel clamp's length. Each of the flanges may include a plurality of scallops. The clamp collar and the barrel clamp may each include a plurality of apertures that are aligned when the clamp collar is closed. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
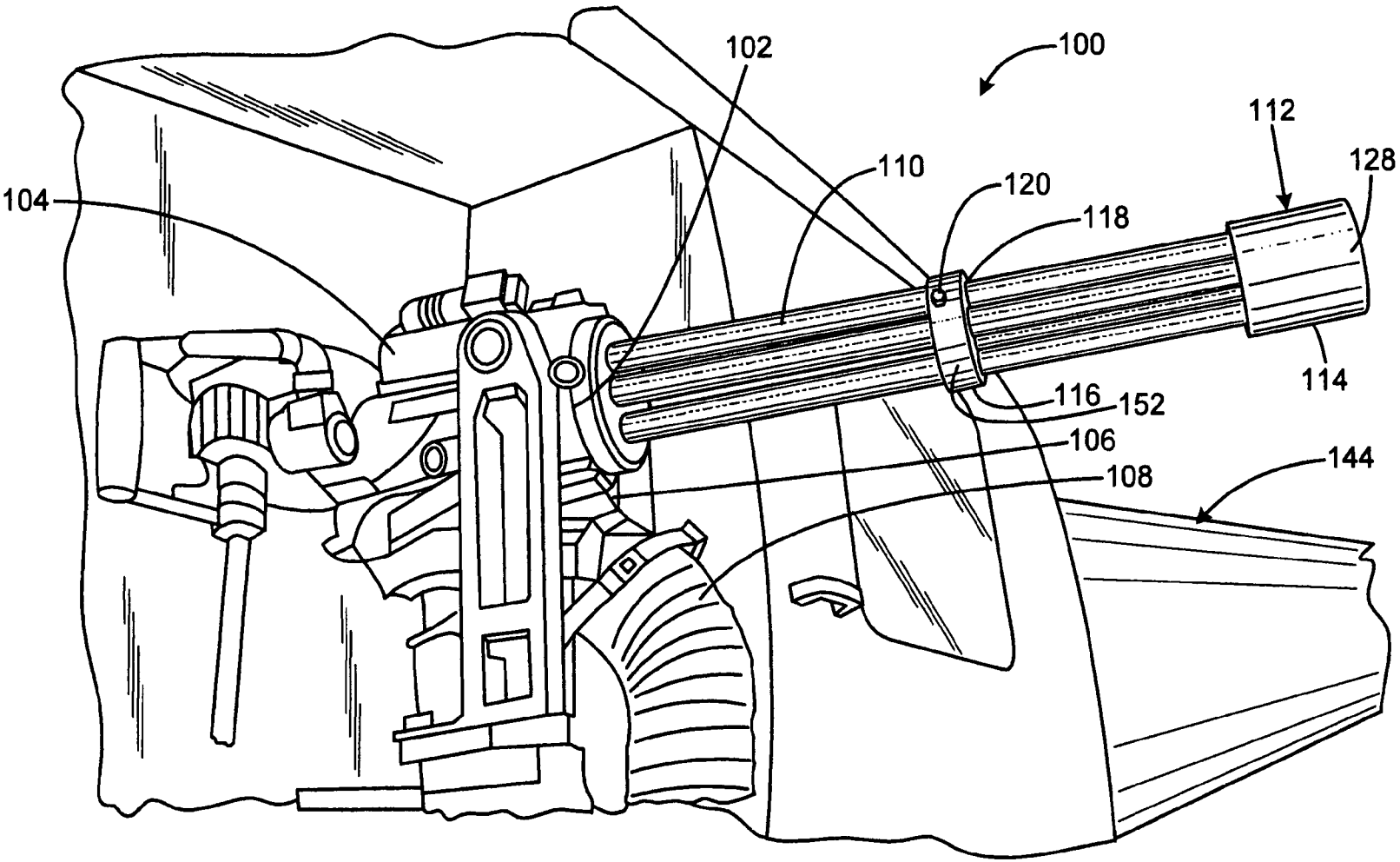
FIG. 1 PRIOR ART
FIG. 1 is a side view of a minigun constructed in accordance with the principles of the present invention.

A preferred embodiment of the barrel clamp safety retainer of the present invention is shown and generally designated by the reference numeral 10.

Figure 8:
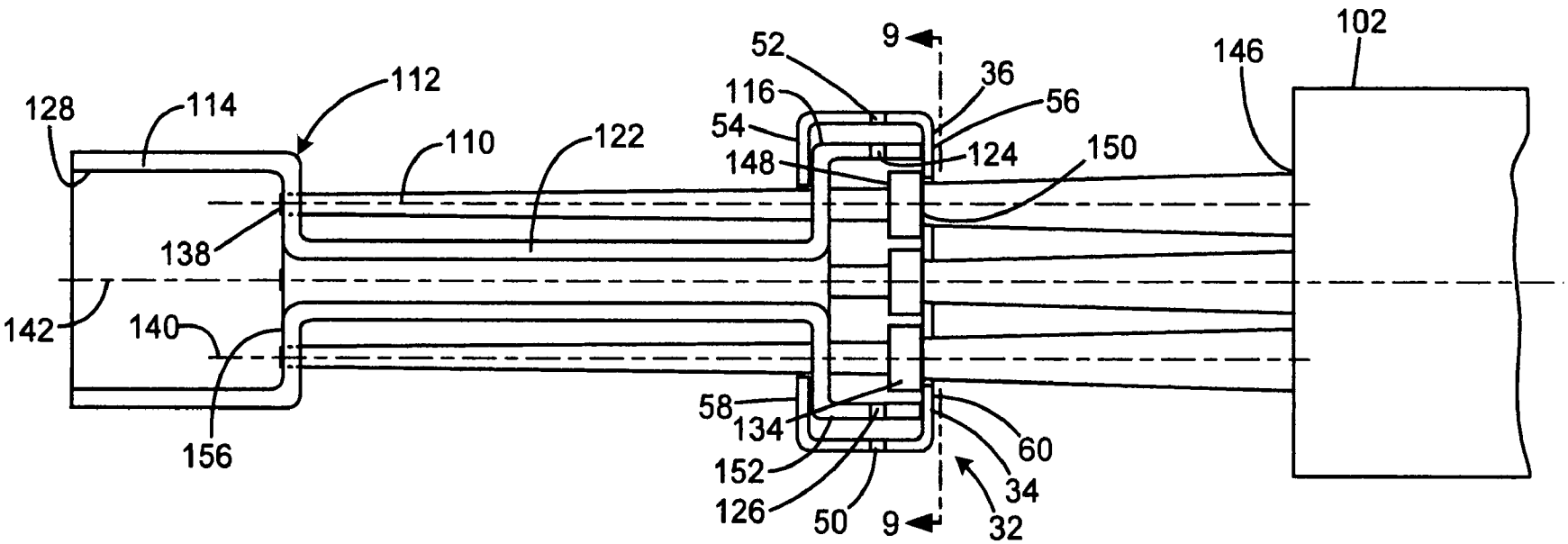
FIG. 8 is a side sectional view of FIG. 4 with the barrel clamp safety retainer of the present invention installed and the barrel clamp bolt missing.

In the context of the specification, the terms "rear" and "rearward" and "front" and "forward" have the following definitions: "rear" or "rearward" means in the direction towards the chamber end 146 of the barrels 110, while "front" or "forward" means in the direction towards the muzzle end 138 (elements 110, 138, 146 are shown in FIG. 8) of the barrels.

Figure 6:
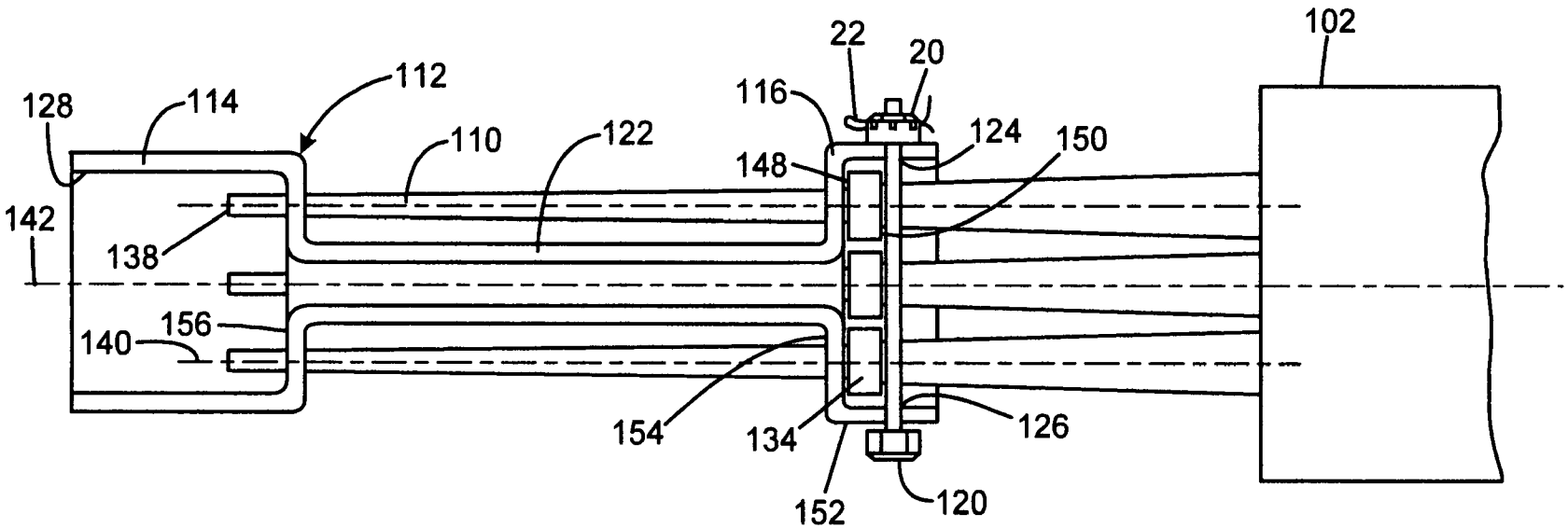
FIG. 6 PRIOR ART
FIG. 6 is a side sectional view of FIG. 3 with the barrel clamp bolt installed.
Figure 7:
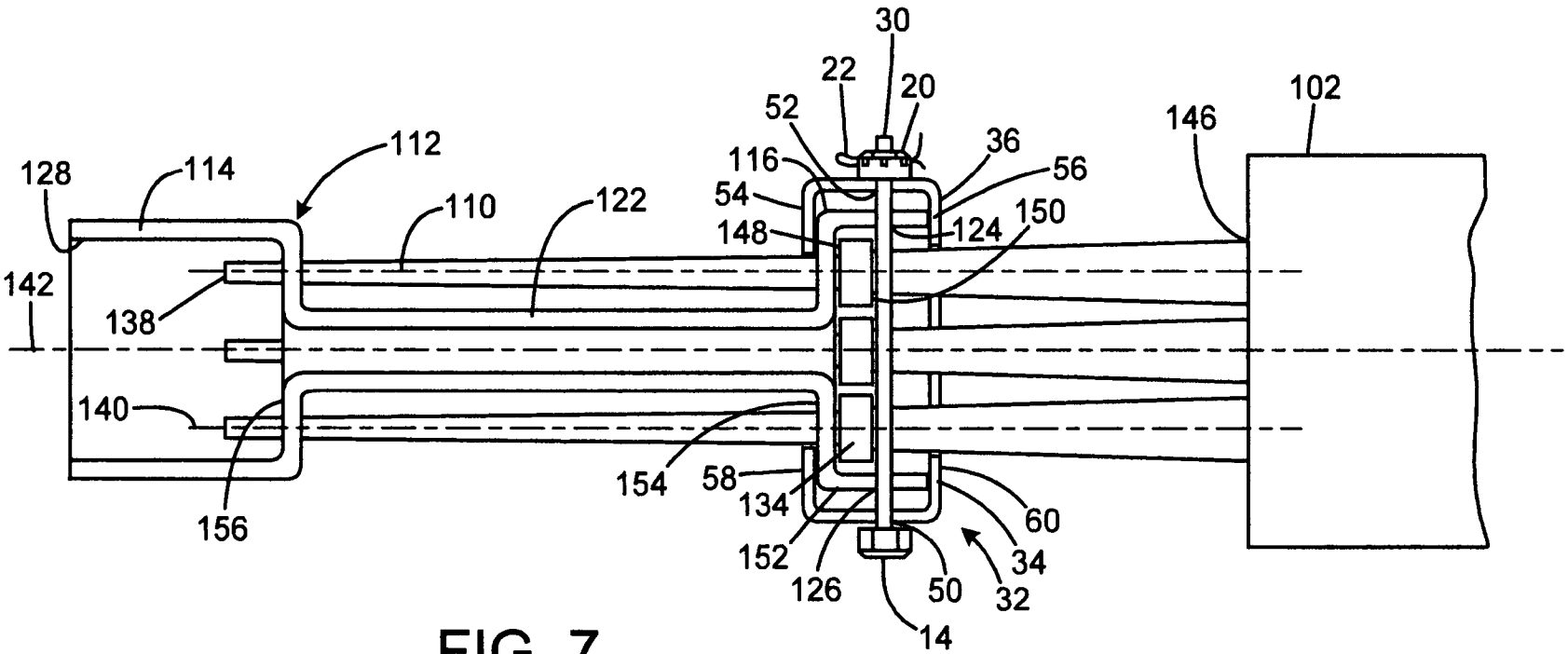
FIG. 7 is a side sectional view of FIG. 4 with the barrel clamp safety retainer of the present invention installed.

FIGS. 1, 2, 3, and 6 illustrate a prior art minigun 100 suitable for use with the present invention installed in a helicopter 144. More particularly, the minigun has a cluster of six barrels 110 protruding from a receiver/rotor 102. Each barrel 110 has a chamber end 146 and a muzzle end 138, and also has a bore defining a bore axis 140 (elements 138, 140, and 146 are shown in FIG. 7). A gun drive motor 104 (shown in FIG. 1) is attached to the receiver/rotor and rotates the barrels. A feeder/delinker 106 is also attached to the receiver/rotor. The feeder/delinker feeds ammunition delivered by the feed chute 108 to the barrels.

Figure 2:
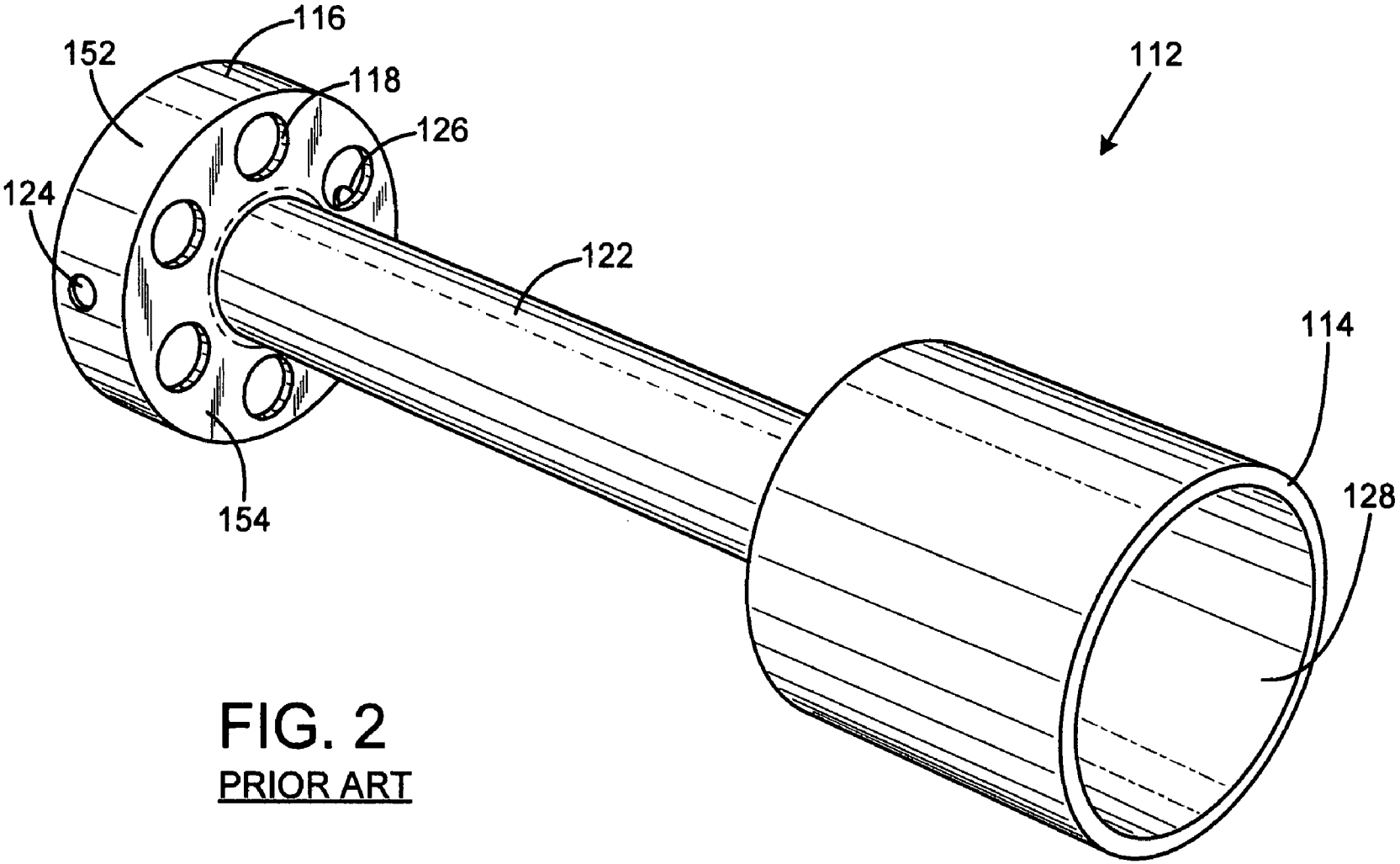
FIG. 2 PRIOR ART
FIG. 2 is a front perspective view of a prior art barrel clamp/flash suppressor.
Figure 3:
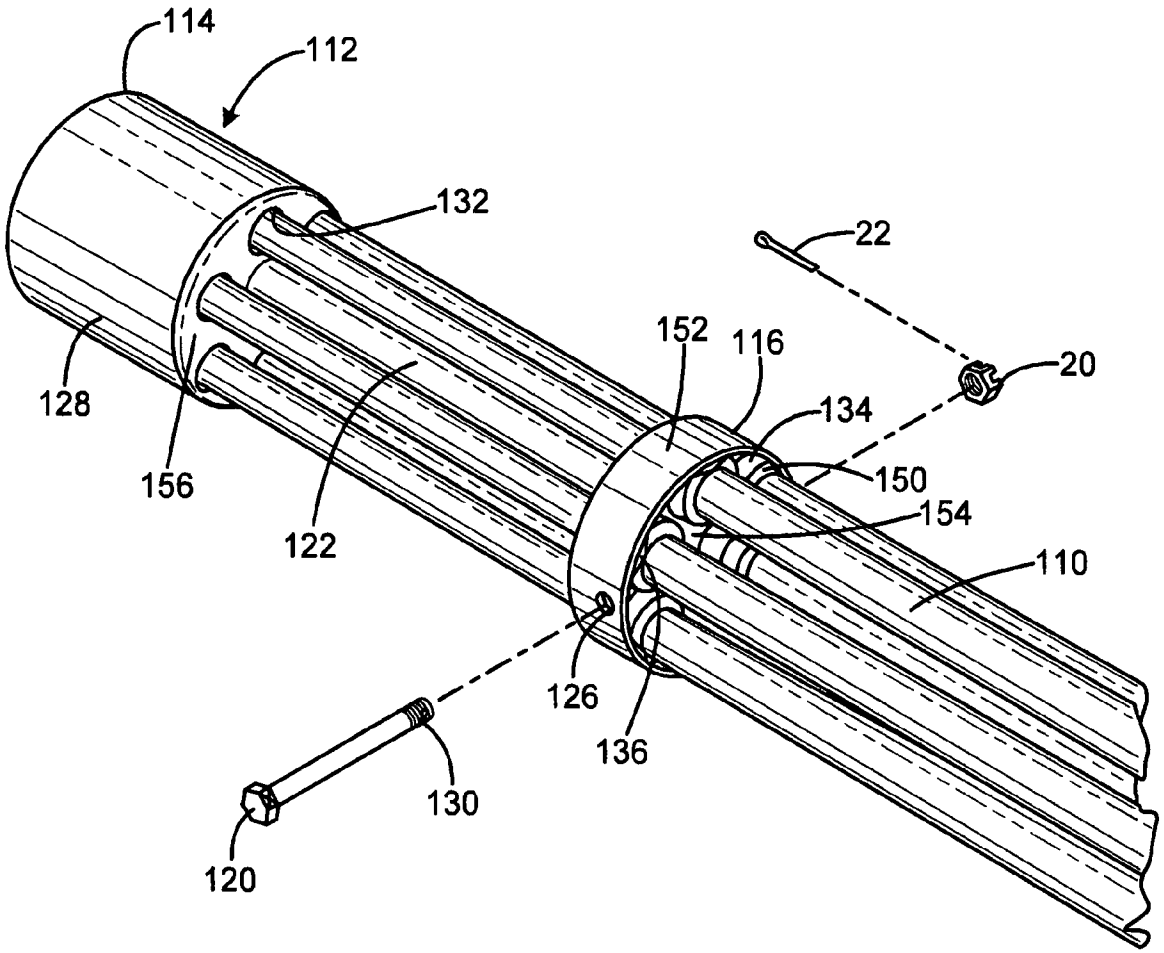
FIG. 3 PRIOR ART
FIG. 3 is a rear perspective exploded fragmentary view of the barrel clamp/flash suppressor of FIG. 2 attached to the barrels of a minigun.

A flash suppressor/barrel clamp 112 (shown in FIG. 1) is attached to the barrels about midway along their lengths. The flash suppressor/barrel clamp is of one-piece construction with a barrel clamp 116 that is connected to a flash suppressor 114 by a shaft 122 (elements 114, 116, and 122 are shown in FIG. 2). The shaft is a hollow tube having opposing open ends and defines a shaft axis 142 (shown in FIG. 6). The barrel clamp has six barrel apertures 118 (shown in FIG. 2) in the barrel clamp's forward surface 154 (shown in FIG. 2) that are parallel to the shaft axis and axially registered with the bore axes 140 to receive the barrels 110 (shown in FIG. 6). The barrel clamp also has two apertures 124 and 126 in a flange portion 152 (elements 124, 126 and 152 are shown in FIG. 2) that are perpendicular to the shaft axis and receive a barrel clamp bolt 120 (shown in FIG. 3).

Each of the six barrels 110 has a barrel lug 134 (shown in FIG. 6) about midway along its length. Each barrel lug is formed by a short, cylindrical portion having a diameter that is larger than the maximum diameter of the barrels forward of the lug. The lug creates a protrusion that extends perpendicular to the bore axis 140. Each barrel lug has a forward surface 148 (shown in FIG. 6) and a rear surface 150 (shown in FIG. 6). The barrel apertures 118 (shown in FIG. 2) in the barrel clamp 112 (shown in FIG. 2) have a diameter that is greater than the maximum diameter of the barrels forward of the lugs, but is smaller than the diameter of the lugs. This diameter permits the muzzle ends of the barrels to pass through the barrel apertures 118, but prevents the lugs from passing through the barrel apertures 118.

The flash suppressor 114 (shown in FIG. 2) portion of the flash suppressor/barrel clamp 112 (shown in FIG. 2) is a can-like body with an open forward end. It has six barrel apertures 132 (shown in FIG. 3) defined in a rear panel portion 156 (shown in FIG. 3) that are parallel to the shaft axis 142 and axially registered with the bore axes 140 to receive the barrels 110 (elements 110, 140, and 142 are shown in FIG. 6). The muzzle end of the flash suppressor forms a flange 128 (shown in FIG. 6) that encircles the muzzle ends 138 (shown in FIG. 6) of the barrels. The flange portion of the flash suppressor extends well forward of the muzzle ends to suppress flashes emitted from the muzzle ends resulting from firing of the minigun. The muzzle ends extend 0.560 inches beyond the forward surface 156 (shown in FIG. 6) of the flash suppressor when the flash suppressor/barrel clamp is in its normal operating position.

To install the flash suppressor/barrel clamp 112 (shown in FIG. 2), the barrel clamp 116 (shown in FIG. 2) is slid onto the barrel cluster by inserting the muzzle ends 138 (shown in FIG. 6) through the barrel apertures 118 (shown in FIG. 2) and is slid rearward towards the receiver/rotor 102 (shown in FIG. 6). The muzzle ends eventually are inserted through the barrel apertures 132 (shown in FIG. 3) in the flash suppressor 114 (shown in FIG. 3). The barrel clamp 116 (shown in FIG. 3) continues to be slid rearward until the forward portion 154 (shown in FIG. 2) of the barrel clamp contacts the forward surface 148 (shown in FIG. 6) of the barrel lugs 134 (shown in FIG. 6). The barrel clamp bolt 120 (shown in FIG. 3) is then inserted through the apertures 124 and 126 (shown in FIG. 6) in the barrel clamp and secured in place by a castellated nut 20 (shown in FIG. 6) and a cotter pin 22 (shown in FIG. 6). The barrel clamp 116 (shown in FIGS. 2 and 6) is thereby secured in place because the barrel clamp is grounded to the forward surface of the barrel lugs and the barrel clamp bolt is grounded to the rear surface 150 (shown in FIG. 6) of multiple barrel lugs.

Figure 4:
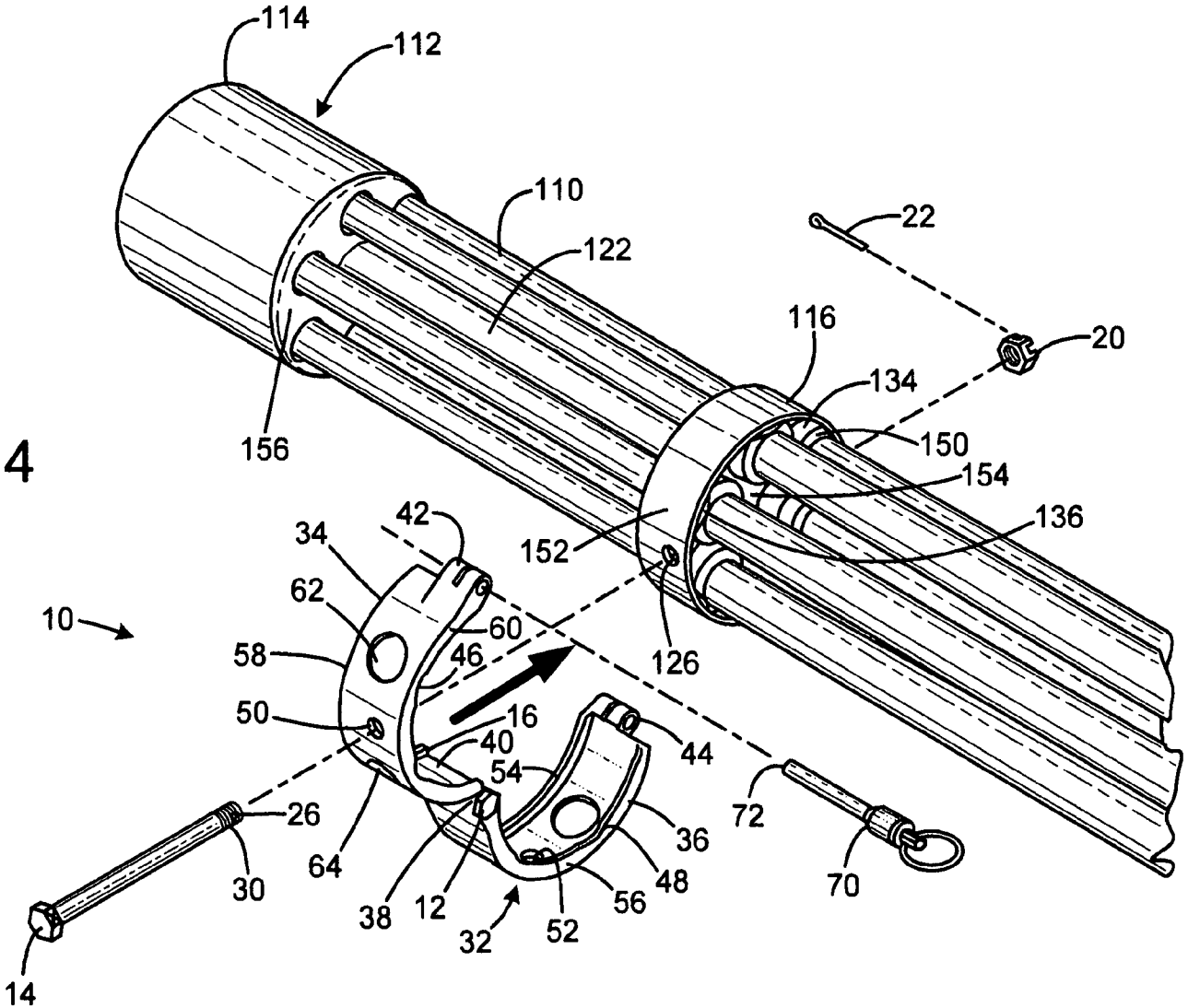
FIG. 4 is a rear perspective exploded fragmentary view of a barrel clamp safety retainer of the present invention prepared for installation on the barrel clamp/flash suppressor attached to the barrels of the minigun.
Figure 5:
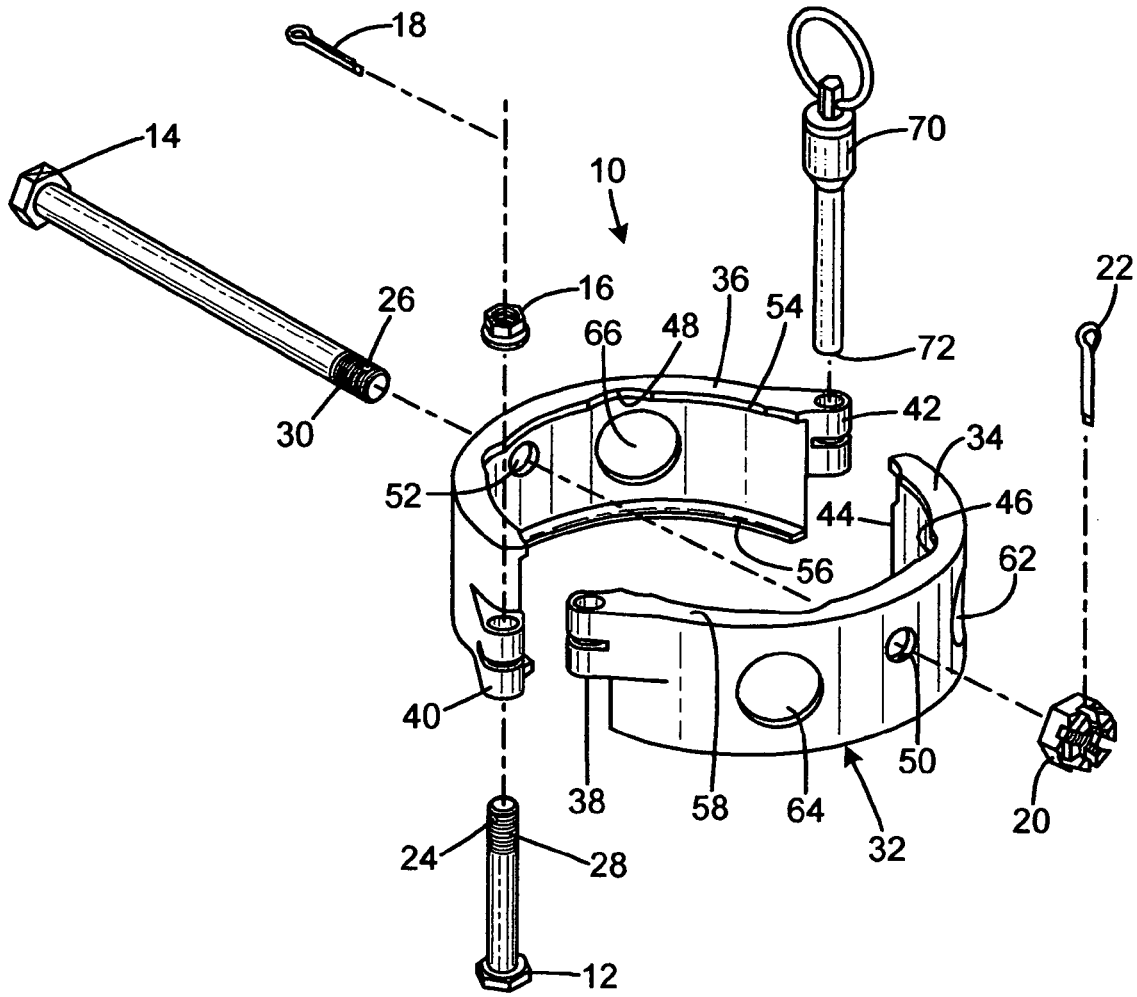
FIG. 5 is a top perspective exploded view of the barrel clamp safety retainer of FIG. 4.

FIGS. 4, 5, and 7 show the barrel clamp safety retainer of the present invention and how it installs onto a prior art minigun 100. The barrel clamp safety retainer is a two-part hinged and pinned clamp collar. The barrel clamp safety retainer has semicircular halves (34 and 36) (shown in FIG. 4) that terminate in hinges (38 and 44, 40 and 42) (shown in FIG. 5). The first half 34 has an aperture-50 (shown in FIG. 5) and two flanges 58 and 60 (shown in FIGS. 5 and 7). The flanges 58 and 60 form scallops 46 (shown in FIG. 9). The second half 36 (shown in FIGS. 5 and 7) has an aperture 52 (shown in FIG. 5) and two flanges 54 and 56 (both shown in FIGS. 5 and 7). The larger apertures 62 and 64 of first half 34 (shown in FIG. 5), and the larger aperture 66 (shown in FIG. 5) and a non-visible third aperture akin to aperture 64 (shown in FIG. 5) in the second half 36 (shown in FIG. 4) are simply lightening holes. The flanges 54 and 56 (shown in FIG. 5) form scallops 48 (shown in FIG. 5). The flanges of each of the halves are spaced apart and have a suitable height to closely fit the flange portion 152 (shown in FIG. 7) of the barrel clamp 116 (shown in FIG. 7). The diameter of the aperture formed by the flange edges is less than the diameter of a circle formed by circumscribing the lugs. The scallops are circular segments having a radius that are sized to give sufficient room for the barrels.

The threaded end 28 (shown in FIG. 5) of a hinge bolt 12 (shown in FIG. 5) passes through hinges 38 and 40 to pivotally attach the two halves 34 and 36 (elements 34, 36 38, and 40 are shown in FIG. 5). The hinge bolt 12 (shown in FIG. 5) is secured by a locking nut 16 and a cotter pin 18 (shown in FIG. 5). The cotter pin 18 passes through a cotter pin hole 24 (shown in FIG. 5) in the threaded end of the hinge bolt.

The pivotal attachment of the two halves 34 and 36 (shown in FIG. 4) enables the barrel clamp safety retainer 10 to be installed after the barrel clamp 116 (elements 10, 34, 36 and 116 are shown in FIG. 4) is already in contact with the forward surface 148 (shown in FIG. 7) of the barrel lugs 134 (shown in FIG. 7), but before the barrel clamp bolt is installed. First, the two halves are clamped onto the barrel clamp so that their flanged portions capture both the forward surface 154 (shown in FIGS. 2 and 7) of the barrel clamp and the rear surface 150 (shown in FIG. 7) of the barrel lugs. The barrel clamp safety retainer is positioned so that the scallops 46 and 48 (shown in FIG. 9) line up with the barrels 110 (shown in FIG. 9) when the two halves are closed and the apertures 50 and 52 (shown in FIG. 5) are aligned with apertures 126 and 124 (shown in FIG. 2) in the flange portion 152 (shown in FIG. 2) of the barrel clamp. A quick release pin 70 has one end 72 (shown in FIG. 4) inserted through hinges 42 and 44 (shown in FIG. 4) to secure the two halves in the closed position. Subsequently, the threaded end 30 of a barrel clamp bolt 14 is inserted through apertures 50 and 52 (elements 14, 30, 50, and 52 are shown in FIG. 4) in the two halves and apertures 126 and 124 (shown in FIG. 2) in the flange portion of the barrel clamp and secured in place by a castellated nut 20 and a cotter pin 22 (shown in FIG. 4). The cotter pin 22 (shown in FIGS. 4 and 5) passes through a cotter pin hole 26 (shown in FIGS. 4 and 5) in the threaded end 30 (shown in FIG. 5) of the barrel clamp bolt. The barrel clamp is thereby secured in place because the barrel clamp is grounded to the forward surface of the barrel lugs and the barrel clamp bolt 14 (shown in FIG. 7) is grounded to the rear surface of multiple barrel lugs. The barrel clamp bolt 14 (shown in FIG. 7) is longer than the prior art barrel clamp bolt 120 to compensate for the addition of the barrel clamp safety retainer 10.

Figure 9:
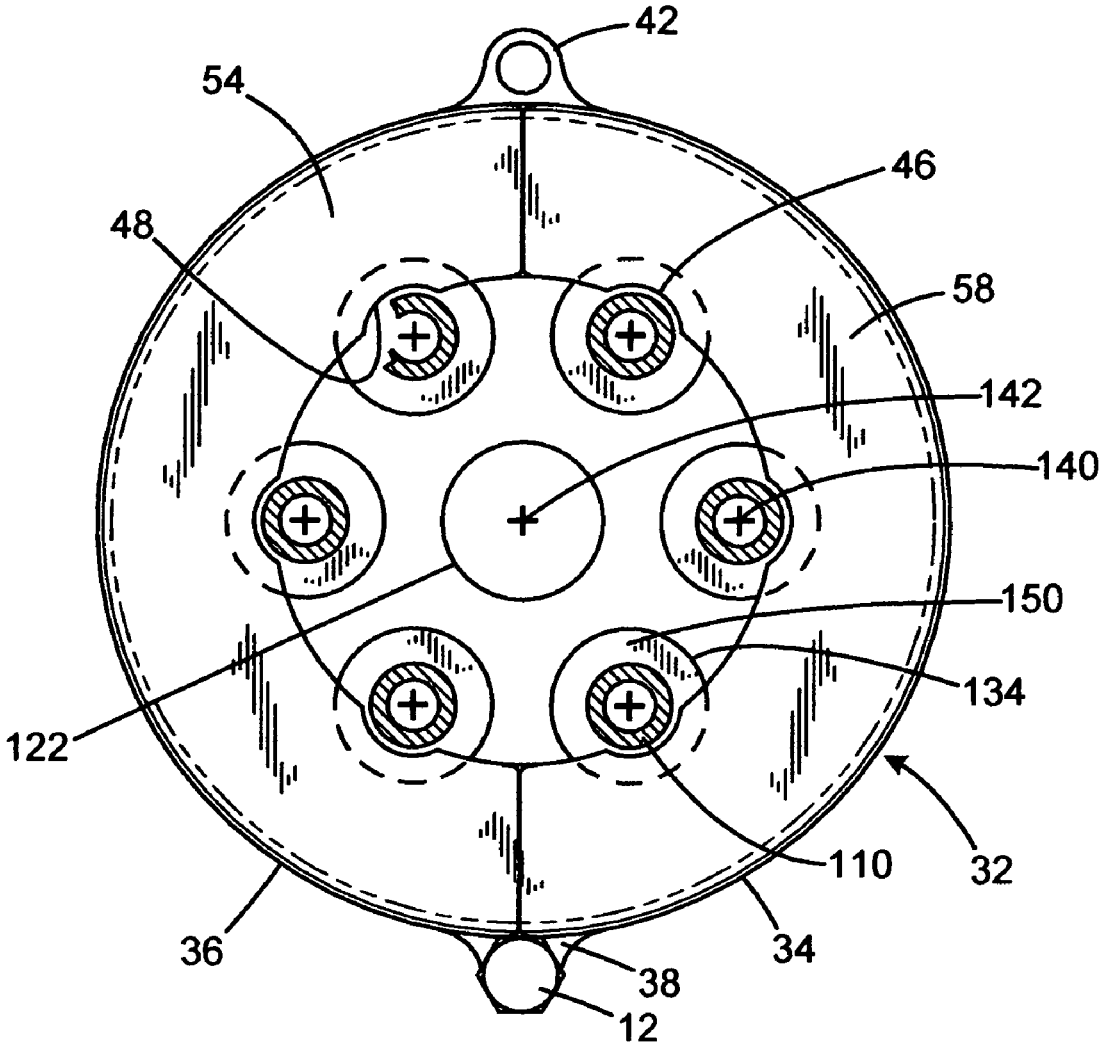
FIG. 9 is a rear sectional view taken along the line 9-9 of FIG. 8.

FIGS. 8 and 9 show how the barrel clamp safety retainer of the present invention retains the flash suppressor/barrel clamp 112 in a safe and functional position on a prior art minigun 100 even if the barrel clamp bolt 14 (shown in FIG. 4) is missing. Because the barrel clamp safety retainer 10 (shown in FIGS. 4, 8, and 9) is installed, the barrel clamp 116 (shown in FIG. 1) can only slide forward by 0.560 inches before the rear flanges 56 and 60 (shown in FIGS. 7 and 8) make contact with the rear surface 150 (shown in FIG. 8) of the barrel lugs 134 (shown in FIG. 8), even if the barrel clamp bolt falls out. This is the same or less than the distance the muzzle end 138 of the barrels 110 protrudes beyond the forward surface 156 of the flash suppressor 114 (elements 110, 114, 138, and 156 are shown in FIG. 8) when the barrel clamp bolt 14 (shown in FIG. 7) is installed. So, the barrel clamp safety retainer prevents the flash suppressor/barrel clamp from sliding forward beyond the muzzle end of the barrels. This prevents the flash suppressor from sliding into the line of fire of the bullets emerging from the barrels, which can ricochet or destroy the flash suppressor, and also ensures the barrel clamp remains secured to the barrels. The barrel clamp safety retainer cannot slide rearward because it is stopped by the contact made between the barrel clamp and the forward surface 148 (shown in FIG. 8) of the barrel lugs.

While a current embodiment of the barrel clamp safety retainer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the one-piece flash suppressor/barrel clamp described may also be divided into separate parts. Furthermore, although installing the barrel clamp bolt after installing the barrel clamp safety retainer has been described, the barrel clamp bolt could alternatively be installed prior to the installation of the barrel clamp safety retainer. In this instance, the alternative embodiment of the barrel clamp safety retainer would also prevent the barrel clamp bolt from falling out. In addition, the semicircular halves of the barrel clamp safety retainer can be manufactured from any suitable material, including stainless steel and titanium. Finally, there may be fewer than six barrels having barrel lugs because the barrel clamp only requires one of the six barrels to have a barrel lug as long as the barrel clamp is located so the barrel clamp bolt can be grounded to the rear surface of the barrel lug.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A machine gun comprising:

a plurality of barrels;

at least one of the barrels having a lug having a first diameter;

each barrel with a lug having a second maximum diameter forward of the lug, and the first diameter of the lug being larger than the second diameter of the barrel;

each barrel having a muzzle end;

a barrel clamp attached to the barrels;

the barrel clamp having a rear portion with apertures to receive the barrels;

the apertures having a third diameter greater than the second diameter of the barrel and smaller than the first diameter of the lug;

the barrel clamp having a front portion with apertures to receive the free end of the barrels; and a clamp collar that captures both the rear portion of the barrel clamp and at least one lug.

2. The machine gun of claim 1, wherein the clamp collar comprises two semicircular pails.

3. The machine gun of claim 2, wherein the two semicircular parts are hingedly attached at one end and releasably pinned at an opposing end.

4. The machine gun of claim 3, wherein each of the flanges includes a plurality of scallops that receive the plurality of barrels.

5. The machine gun of claim 4, wherein the scallops have a she defined by an exterior surface of the plurality of barrels.

6. The machine gun of claim 2, wherein each of the two parts of the clamp collar have forward and rear edges, with a flange depending from each of the edges.

7. The machine gun of claim 6, wherein the two flanges are spaced apart by a distance defined by the rear portion of the barrel clamp's length, such that the collar may encompass the rear portion of the barrel clamp.

8. The machine gun of claim 6, wherein each of the barrels has a lug, and an aperture formed by the flange edges has a diameter less than a diameter formed by a circle circumscribing the lugs.

9. The machine gun of claim 1, further comprising:

the clamp collar including a plurality of apertures;

the barrel clamp including a plurality of apertures; and wherein the apertures of the clamp collar and the apertures of the barrel clamp are aligned to receive a bolt when the clamp collar is closed.

10. The machine gun of claim 9, wherein a bolt received by the apertures of the clamp collar and apertures of the barrel clamp contacts a rear surface of at least one of the barrel lugs.

* * * * *